US006655310B1

(12) United States Patent
Francis

(10) Patent No.: US 6,655,310 B1
(45) Date of Patent: Dec. 2, 2003

(54) SPRING LOADED BOLLARD

(76) Inventor: Rex William Francis, 27 Dunstan Road, Avonsleigh, Victoria 3782 (AU)

( * ) Notice: Subject to any disclaimer, the term of this patent is extended or adjusted under 35 U.S.C. 154(b) by 0 days.

(21) Appl. No.: 10/089,867

(22) PCT Filed: Oct. 9, 2000

(86) PCT No.: PCT/AU00/01222

§ 371 (c)(1),
(2), (4) Date: Apr. 4, 2002

(87) PCT Pub. No.: WO01/25081

PCT Pub. Date: Apr. 12, 2001

(30) Foreign Application Priority Data

Oct. 7, 1999 (AU) ..... PQ3301

(51) Int. Cl.[7] ..... B63B 21/04
(52) U.S. Cl. ..... 114/218; 114/215
(58) Field of Search ..... 114/218, 215

(56) References Cited

U.S. PATENT DOCUMENTS 104,425 A * 6/1870 Cheney et al. ..... 114/215

* cited by examiner

*Primary Examiner*—Ed Swinehart
(74) *Attorney, Agent, or Firm*—Notaro & Michalos P.C.

(57) ABSTRACT

A spring loaded bollard assembly for the selective engagement and/or disengagement of a cable (as hereinbefore defined) includes a base member which is adapted to be mounted on or to a given surface, as for example a boat hull, pier, jetty or the like, and a cable receiving and retaining means releasably attachable to that base member, the cable receiving and retaining means including a housing which is releasably attachable to the base member, that housing including guide roller means for controlling the direction of movement of the cable and means for capturing that cable, the capture means being spring loaded to allow for selective and progressive relaxation and/or tightening of the cable, subject to the vagaries of the elements, including tide and weather.

17 Claims, 4 Drawing Sheets

SPRING LOADED BOLLARD

The present invention relates, in general terms, to improvements in means for handling a line, rope, hawser, chain, cable or the like. More particularly, but not exclusively, the invention relates to an improved device for engaging and disengaging a line rope, hawser, chain, cable or the like, particularly suited for use in a nautical sense.

For ease of explanation, throughout the following specification the expression "cable" will be employed. It should be understood, however, that such expression is intended to include within its scope or meaning a line, rope, chain, hawser or in fact any elongate material used for interconnection, anchoring or moving of vessels, etc.

Throughout the ensuing specification reference will be made in more detail to a particular and preferred embodiment of the present invention, involving a spring-loaded arrangement—being the equivalent of a bollard—for use in conjunction with a cable and, for example, an associated anchor on a marine vessel of any given type. It must be realised, however, that the invention is not to be considered to be restricted to that preferred embodiment. In actual fact the device or apparatus in accordance with the present invention lends itself readily to usage in any context wherein a vessel is to be moored or anchored.

Bollards or the equivalent are traditionally used on sea-going vessels, for example, for securing hawser rope, anchor chain or the like, not only when the vessel is moored or at anchor, but also when the vessel is moving or drifting without being in any way moored or anchored. Past experience has shown that, if moored or at anchor, with the anchor set, stress shocks can be induced in or suffered by a vessel, caused to the sudden imposition of an excessive force on the bollard or anchor means due to any movement experienced by the vessel itself. Such movement could be caused by a variety of means, as for example by drifting of the vessel from its place of moorage under the influence of currents, etc. The end result of such stress shocks can take a variety of forms. By way of example, it has been known that such stress shocks can give rise to actual breakage, as by snapping, of an anchor chain. Other possible undesirable effects include release of the anchor from its hold, snapping of the bollard from the deck of the vessel, etc.

Various attempts have been made in the past to avoid the onset of such stress shocks. For example "bungee" type or extensible ropes have been employed for purposes of anchoring or mooring, rubber or the like shock absorbing material has been appropriately placed around a bollard or, in the alternative, an inordinately long length of cable or rope may have been employed. Such have proven only marginally satisfactory, however, in turn giving rise to other problems.

Another problem associated with the prior art arrangements as in use has involved the keeping of an anchor chain or the like securely in place in the vessel, against unwanted or undesirable release, when the anchor is not in use.

The present invention seeks to overcome the problems and disadvantages associated with the prior art by providing an improved arrangement/apparatus, for use in conjunction with a rope, hawser, chain, cable or the like, for the purpose of anchoring or moving a seagoing vessel.

In accordance with a first aspect of the present invention there is provided an apparatus or assembly for the selective engagement and/or disengagement of a cable (as hereinbefore defined), said assembly including a base or cradle member adapted to be mounted on or to a given surface, as for example a boat hull or the like, and a cable receiving and retaining means adapted to be releasably attachable to said base member, said cable receiving and retaining means including: a housing which is adapted to be releasably attachable to said base or cradle member, said housing including guide roller means at or in the vicinity of one end thereof for controlling the movement of said cable; and means for capturing said cable, said capture means being adapted to allow for selective and progressive relaxation and/or tightening of said cable, said capture means being biassed so as to normally adopt a position within said housing at the end thereof remote from said guide roller means, and wherein said capture means is formed from opposed elongate arm members having a web extending therebetween and along at least part of the length thereof, said web including, at its uppermost free edge, a slot disposed substantially centrally thereof, said slot being adapted to receive, and releasably retain against unwanted removal, said cable.

In accordance with another aspect of the present invention there is provided an apparatus or assembly for the selective engagement and/or disengagement of a cable (as hereinbefore defined), adapted to be mounted on or to a given surface, including a cable receiving and retaining means, said cable receiving and retaining means including: a housing which is adapted to be releasably attachable to said surface, said housing including guide roller means at or in the vicinity of one end thereof for controlling the movement of said cable; and means for capturing said cable, said capture means being adapted to allow for selective and progressive relaxation and/or tightening of said cable, said capture means being biassed so as to normally adopt a position within said housing at the end thereof remote from said guide roller means, and wherein said capture means is formed from opposed elongate arm members having a web extending therebetween and along at least part of the length thereof, said web including, at its uppermost free edge, a slot disposed substantially centrally thereof, said slot being adapted to receive, and releasably retain against unwanted removal, said cable.

DESCRIPTION OF THE DRAWINGS

In order that the invention may be more clearly understood and put into practical effect reference will now be made in more detail to preferred embodiments of an improved device for handling a cable in accordance with the invention. The ensuing description is given by way of non-limitative example only and is with reference to the accompanying drawings, wherein.

DESCRIPTION OF THE PREFERRED EMBODIMENTS

Figure 1:
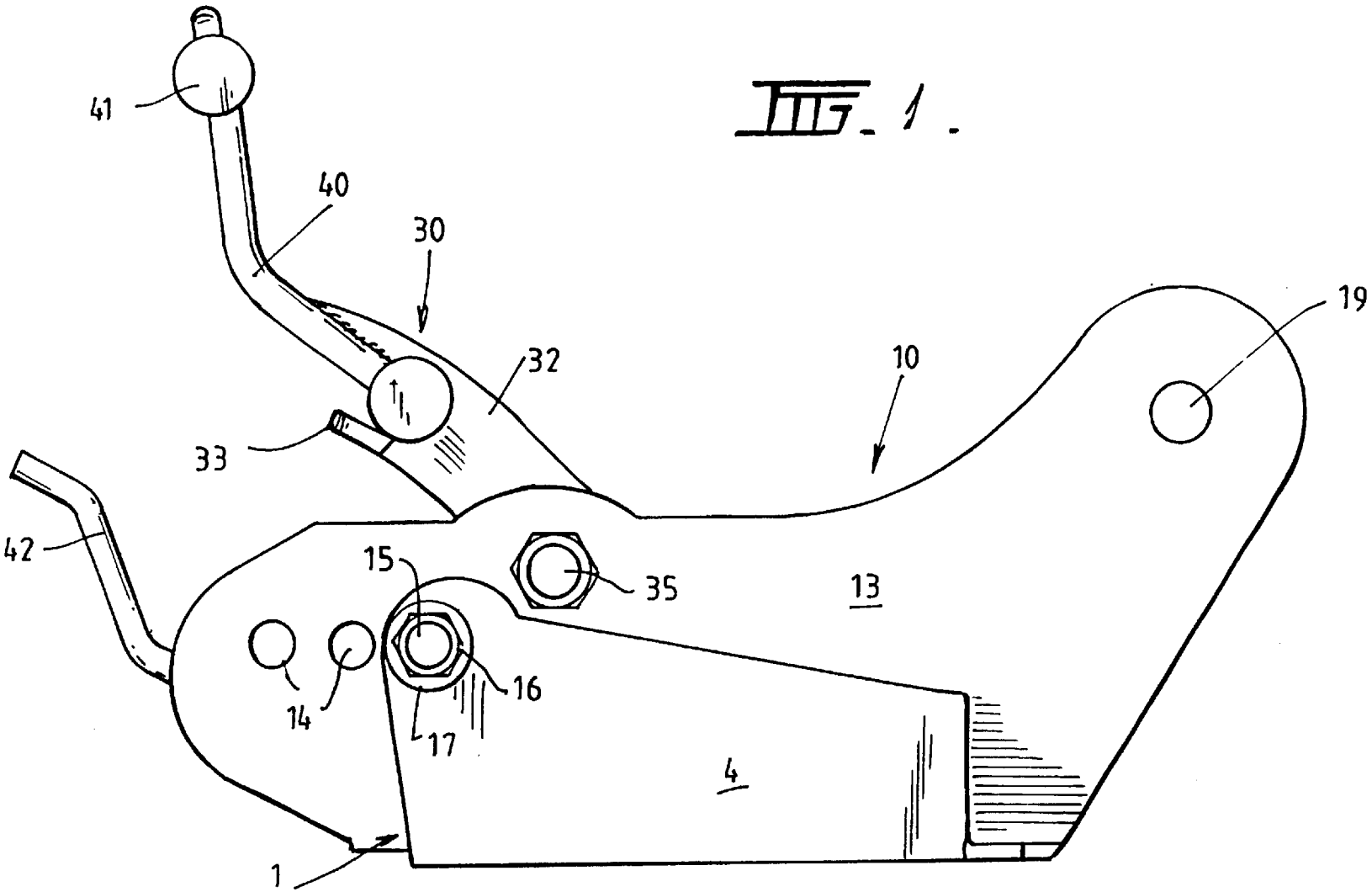
FIG. 1 is a side elevational view of an apparatus in accordance with the invention.

As shown for example in FIG. 1, an apparatus in accordance with the present invention includes a cradle or base means, generally designated 1. Such cradle or base means 1 is adapted, in use, to be releasably attachable to a given surface. In an especially preferred embodiment, such surface will be on a vessel of any known type. It should be understood, however, that the arrangement in accordance with the present invention could also be installed on a fixed or stationary surface, as for example a pier, wharf, jetty or the like. For ease of explanation, however, in the ensuing description reference will be made to the overall apparatus in accordance with the present invention as installed on a vessel.

In one configuration the apparatus in accordance with the present invention can be releasably attached to the deck of a given vessel, preferably at or in the vicinity of the bow thereof. Alternatively, and for reasons to be explained later in this specification, the apparatus in accordance with the present invention could be located below deck on such vessel, as for example by being releasably affixed to the hull and internally thereof. The cradle means 1 may be affixed releasably to the associated surface in any known way and with any suitable means. In an especially preferred embodiment such cradle means 1 may be bolted to the deck or the hull of the vessel itself. In such a configuration the cable, with anchor attached to the free end thereof, is adapted to pass through an aperture provided or formed in the hull of the vessel. This means that the operation of setting or releasing of the anchor can be performed from actually inside the hull of the vessel, a procedure which is both more comfortable and safer for the boat operator or person designated to carry out the relevant task.

In the preferred embodiment illustrated the cradle means 1 is of a substantially unitary construction, being made up of a substantially flat and elongate base member 2 and opposed relatively upwardly extending wing members 3 and 4. The elongate base member 2 is adapted, in use, to be releasably attachable to a given flat surface, as for example the deck or hull of a vessel. To allow therefor the base member 2 preferably includes therein a plurality of pre-formed apertures (not shown), to receive suitable fixing means (not shown). The wing members 3 and 4 extend substantially normally to the base member 2. Each wing member 3, 4 includes, in the vicinity of one end thereof, at least one hole or aperture 5, for a purpose to be explained hereinafter in more detail.

The apparatus in accordance with the present invention further includes a cable receiving and retention means, generally designated 10, which is adapted in use to be releasably attachable, again in any known manner and using any suitable means, to the cradle or base means 1. The cable retention means 10, as illustrated, is preferably of a unitary construction and includes a base member 11 and opposed upwardly extending wing members 12 and 13. Each wing member 12, 13 includes, at or in the vicinity of one end thereof, a plurality of aligned holes or apertures 14. In the preferred embodiment illustrated the cable retention means 10 is adapted to be releasably affixed to the cradle means 1 per medium of one or more bolts or the like members 15 which is or are adapted to protrude through one or more opposed pairs of apertures 14 in said wings 12 and 13, though the aperture 5 of the wing members 3 and 4 of cradle means 1, and then to be secured through the use of a lock-nut or the like means 16 and an associated washer 17. The plurality of opposed pairs of apertures 14 provided in the wing members 12 and 13 allow for relative adjustment of the cable retention means 10 within the cradle means 1, to suit different sized vessels, different desired locations for the overall apparatus, etc.

The base member 2 of the cradle means 1 further includes, at at least one end thereof, an upstanding lip or flange 6 which is adapted, in use, to be located within, and releasably received by, a slot or the like formed in the associated end of the base member 1 of the cable receiving and intention means 10. Such an arrangement assists in location of the intention means 10 relative to the cradle means 1.

Figure 2:
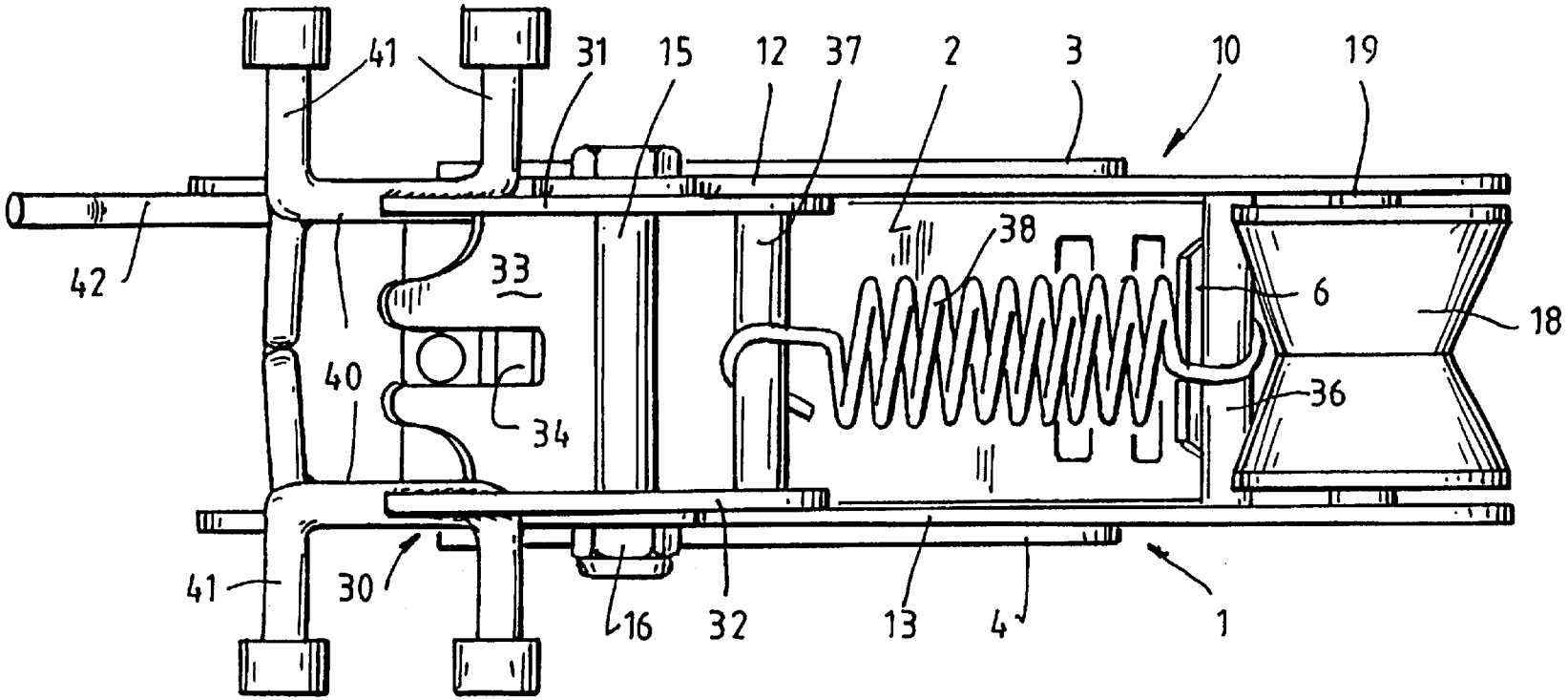
FIG. 2 is a top view of the apparatus of FIG. 1.

The cable retention means 10 includes, at one end thereof and extending laterally of the wing members 12 and 13, a guide roller means 18. In the preferred embodiment illustrated the guide roller means 18 is rotatably movable relative to a shaft, pintle or the like member 19 extending between opposed end extremities of the wing members 12 and 13 and fixedly attached thereto, as for example by welding. As shown in FIG. 2 the guide roller means 18, of a unitary construction, is preferably shaped so as to not only receive the cable but to also retain such cable against unwanted separation or withdrawal therefrom.

The cable retention means 10 further includes an elongate member 20 extending laterally of the housing and fixedly attached, as by welding for example, to the wing members 12 and 13. In use this member 20 constitutes a rest for a lever mechanism 30, to be explained or describe hereinafter in more detail.

Associated with the retention means 10, and pivotably movable relative thereto, is a lever mechanism generally designated 30. In the especially preferred embodiment illustrated the lever mechanism 30 is made up from opposed arm members 31 and 32 having a web 33 extending therebetween. The web 33 has, at the upper edge thereof, a slot 34 which is adapted to assist in retention of the cable, in a manner to be explained hereinafter in more detail.

Each arm member 31, 32 has an aperture extending therethrough. An elongate member 35 is adapted, in use, to extend laterally of the lever mechanism 30, through the aperture of each arm member 31, 32, and, in turn, through mating apertures provided in wing members 12 and 13. The elongate member 35 constitutes a pivot axis for the overall lever mechanism 30.

Figure 3:
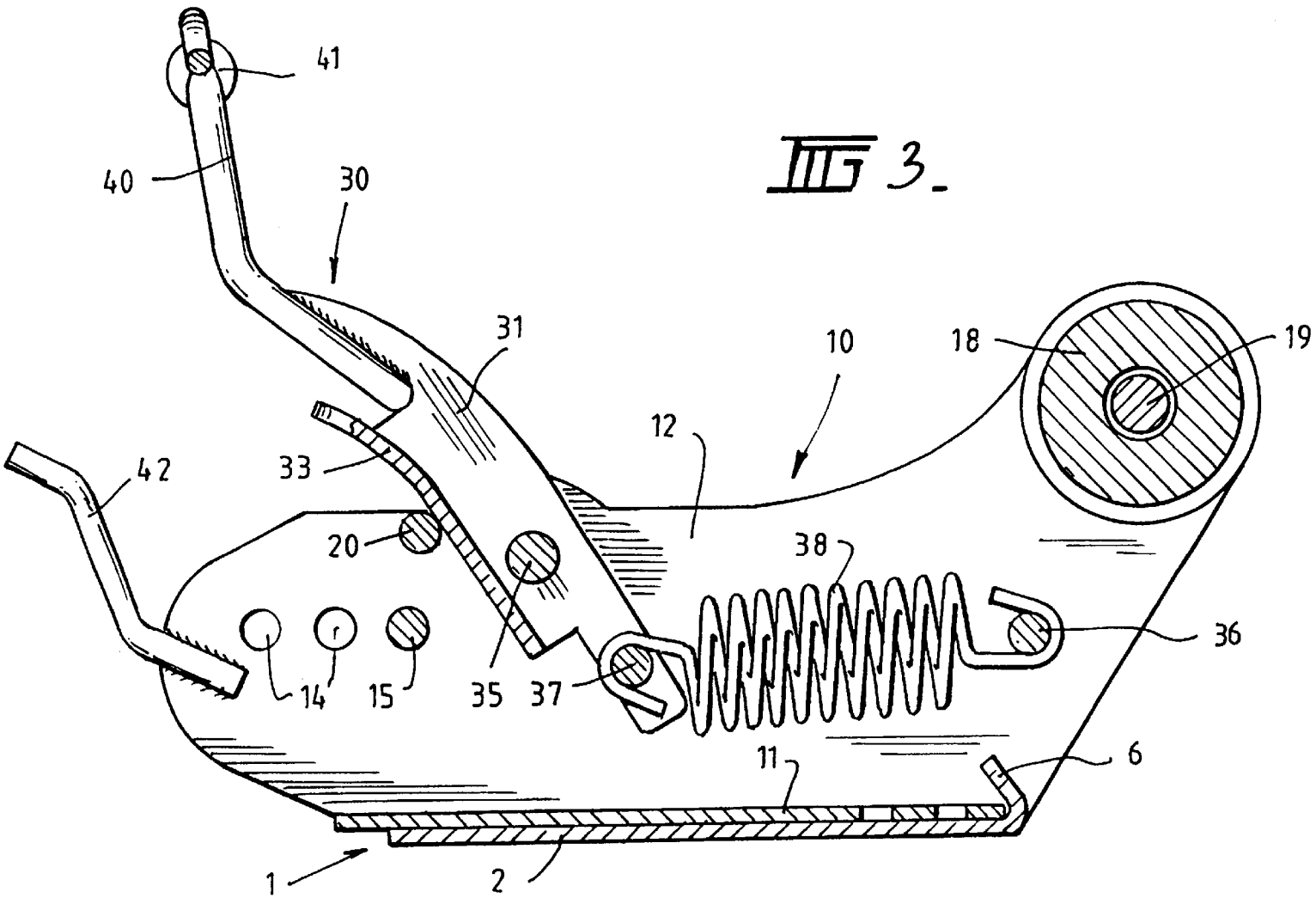
FIG. 3 is a sectional view, from the side, of the apparatus of FIGS. 1 and 2, in its relaxed operating condition.

The cable receiving and retention means 10 includes, at a position removed spatially from the guide roller 18, a shaft, pin or pintle 36 extending laterally thereof, and preferably attached at each end to the associated wing member 12 or 13 in any suitable manner, as for example by welding. At or in the vicinity of the lowermost end of each arm member 31, 32 of the lever mechanism 30, and extending laterally therebetween, is a further shaft, pin or pintle 37, also fixedly attached to the respective arm members 31 and 32 as by welding. Attached to such shafts, pins or pintles 36 and 37 are the respective free ends of a suitable biassing means, as for example a tension spring 38. The arrangement is such that, in use, the overall lever mechanism 30 is normally in the position shown in FIGS. 1 to 3.

In the especially preferred embodiment illustrated, see FIG. 2, the lever mechanism 30 includes the aforementioned respective arm members 31 and 32, each having an elongate extension arm 40 formed integrally therewith and extending substantially upwardly therefrom, such assisting in gripping thereof by the operator. Each such extension are has at least one, and preferably two as shown in FIG. 2, flanged projections 41 extending laterally and externally thereof, to not only assist in gripping but also to allow for looping or lashing of the cable.

In the preferred embodiment illustrated the wing member 12 of the retention means 10 includes at least one further member 42 projecting substantially rearwardly thereof. Such member 42 is adapted to receive and releasably retain a cable, chain or the like to which an anchor may be attached, acting as a safety locking device therefor, to prevent unwanted release of the cable and associated anchor.

Figure 4:
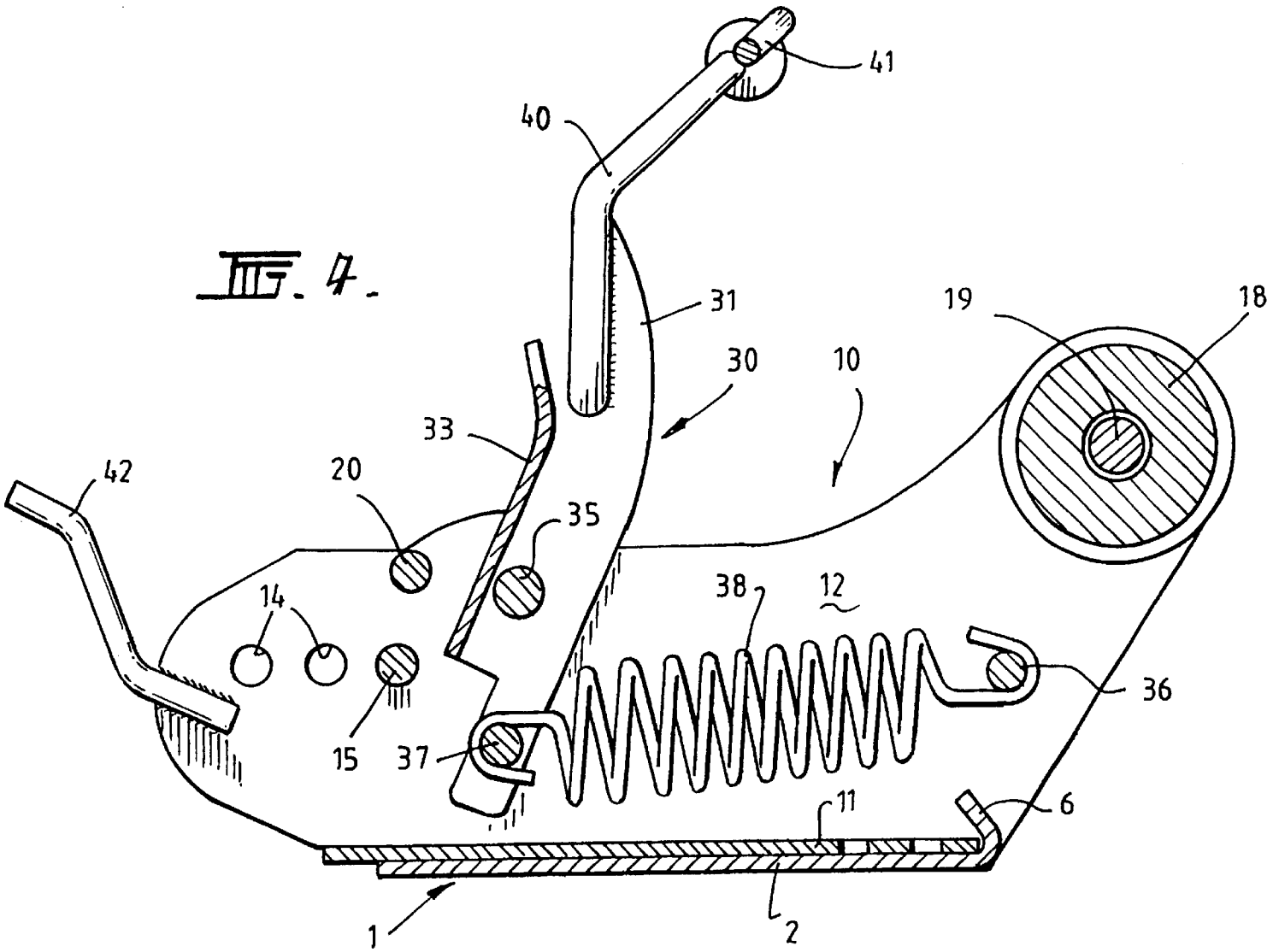
FIG. 4 is a view, similar to FIG. 3, but showing the arrangement in accordance with the present invention in its alternative operating condition or configuration.

The principal of operation of the apparatus/assembly in accordance with the present invention is as follows. When installed on a vessel, the cable or chain is received and retained by the roller means 18, to extend through the lever mechanism 30 to be "dogged" or engaged through the slot 34, then to be looped or around or attached to either the safety locking member 42 and/or the flanged projections 41. When in that configuration the anchor is held against unwanted release, yet the spring biassing means allows the lever mechanism 30, having the anchor cable associated therewith, to move freely between the positions shown in FIGS. 3 and 4 subject to the vagaries of the currents and/or the elements. By being free to thus move, yet being normally biassed towards, the rest position shown in FIGS. 1 to 3, any undue stresses or loads caused by movement of the vessel can/or anchor can be absorbed. Thus the potential for hull damage due to impact loads or stresses is substantially eliminated.

The arrangement in accordance with the present invention is responsible for a number of important practical advantages when compared with those arrangements known and presently in use. Such advantages are explained hereinafter in more detail.

Firstly, the present applicant's arrangement affords improved safety to the user. In one preferred embodiment the apparatus or assembly in accordance with the present invention can be located at or in the vicinity of the front of the vessel, in conjunction with a bow-sprit. Such has been found to be a most effective location for an anchor, in terms of actual effectiveness and, perhaps even more importantly, ease and safety of laying/setting and lifting.

Secondly, and this especially when the arrangement in accordance with the present invention is actually physically located internally of the vessel, be that either removed spatially from the side of the vessel or internally of the hull of itself of the vessel, it affords improved safety to the user in choppy seas or rough weather. Indeed the present applicant's arrangement, by allowing for in effect remote operation, minimises the possibility of a "man overboard" situation, which can sometimes arise when an anchor is being laid/set or retrieved. The operator does not have to venture to the very front/bow of the vessel to lay or retrieve an anchor.

The arrangement or assembly in accordance with the present invention, by being readily removable from the base or cradle member, lends itself for easy storage, affords the possibility of ready cleaning thereof, etc.

The present applicant's arrangement has been found to absorb impact loads induced by an anchor, yet in no way to inhibit the holding power of such anchor. As previously mentioned, impact loading has been found, in some instances, to give rise to unwanted cracking or damage to the hull of the vessel. The advantages associated with eliminating the onset of such cracking or damage should be apparent.

With past practices, the actual act of dropping or retrieving an anchor sometimes gave rise to damage to the hull of the vessel, due to the degree of difficulty associated therewith. By simplifying and facilitating such procedures, the possibility of damage to the vessel hull is virtually eliminated.

Finally, it is to be understood that the aforegoing description refers merely to preferred embodiments of the invention, and that variations and modifications will be possible thereto without departing from the spirit and scope of the invention, the ambit of which is to be determined from the following claims.

What is claimed is:

1. An apparatus for use in the setting and retrieving of an anchor for a vessel, said apparatus including: a cradle member adapted to be mounted on a surface of a vessel; and receiving means for releasably receiving and retaining a cable and associated rope of said anchor, said receiving means including a housing having guide roller means connected to one end thereof for controlling the movement of said cable and rope, the cable and rope adapted to pass over the guide roller means; capture means for capturing and retaining said cable and rope against release, said capture means adapted to permit selective and progressive relaxation or tightening of the cable and rope, said capture means being biased normally disposed at a position within said housing at an end of the housing opposite the guide roller means and selectively and progressively pivotally movable relative to the housing, said capture means being formed from opposed elongate arm members having a web extending therebetween and along at least part of the length thereof, said web including, at an uppermost free edge, a slot disposed substantially centrally thereof, said slot being adapted to receive and releasably retain the cable and rope against unwanted removal.

2. The apparatus as claimed in claim 1, wherein said capture means is pivotably mounted within said housing.

3. The apparatus as claimed in claim 1 or claim 2, wherein said cradle member includes opposed substantially parallel wing members interconnected by a base web, said base web including therein one or more apertures including fixing means for releasably affixing said cradle member to said surface.

4. The apparatus as claimed in claim 3, wherein said housing of said receiving means is formed from an elongate base and opposed wing members extending substantially normally to opposite ends thereof, said opposed wing members each including a plurality of apertures in the vicinity of one end thereof, to allow for selective and variable location of said retaining means relative to said cradle member.

5. The apparatus as claimed in claim 4, wherein said cradle member has a flange extending substantially upwardly to the cradle member, the flange located at a free end the base web, said flange assisting in location of said housing within said cradle member and constituting a limit stop for relative movement therebetween.

6. The apparatus as claimed in claim 5, wherein said elongate base of said housing includes, at a base end thereof engaged by said flange of said cradle member, a slot for receiving and releasably co-operating with said flange.

7. The apparatus as claimed in claim 6, wherein said elongate arm members of said capture means each include at least one lateral protrusion, for securing said cable and rope thereto.

8. The apparatus as claimed in claim 7, wherein said housing further includes, at the end of the housing opposite the guide roller means and protruding rearwardly therefrom, at least one shaped projection on which said cable and rope is adapted to be attached, whereby attaching the cable and rope provides a further locking means protecting against unwanted release of said cable and rope.

9. The apparatus as claimed in claim 8, wherein said housing includes, at one end thereof, a first pin, shaft or pintle extending laterally thereof, and wherein said capture means includes at least one second pin, shaft or pintle, extending laterally thereof between said elongate members, the arrangement further including a tension spring attached to each of said first and second pins, shafts or pintles and extending therebetween, providing spring biased relative movement between said capture means and said housing.

10. The apparatus as claimed in claim 9, constructed principally from stainless steel.

11. An apparatus for the selective engagement and disengagement of a cable, the apparatus being adapted for mounting on a surface, the apparatus having cable receiving means for receiving and retaining the cable, the cable receiving means including: a housing releasably attached to the surface, the housing including guide roller means for controlling the movement of the cable, the guide roller means provided at a first end of the housing; and, capture means for capturing the cable, the capture means permitting selective and progressive relaxation and tightening of the cable, the capture means biased normally disposed at a position within the housing at a second end opposite the first end, and selectively and progressively pivotally movable relative to the housing, wherein the capture means is formed by opposed elongate arm members having a web extending therebetween and along at least part of the length of the web, the web having, at an uppermost free edge, a slot disposed substantially centrally in the web, the slot releasably receiving and retaining the cable against unwanted removal.

12. The apparatus as claimed in claim 11, wherein said capture means is pivotably located within said housing.

13. The apparatus as claimed in claim 12, wherein said housing of said cable receiving means is formed from an elongate base and opposed wing members extending substantially normally to opposite ends of the base.

14. The apparatus as claimed in claim 13, wherein said elongate arm members of said capture means each include at least one lateral protrusion, for securing the cable thereto.

15. The apparatus as claimed in claim 14, wherein said housing further includes, at the second end thereof remote from said guide roller means and protruding rearwardly from the housing, at least one shaped projection to which said cable is adapted for attachment thereby providing a locking means for protecting against unwanted release of said cable.

16. The apparatus as claimed in claim 15, wherein the first end of said housing includes a first pin, shaft or pintle extending laterally, said capture means includes at least one second pin, shaft or pintle, extending laterally between said elongate members, and further comprising a tension spring attached to said first and second pins, shafts or pintles and extending therebetween, permitting spring-biased relative movement between said capture means and said housing.

17. The apparatus as claimed in claim 16, constructed principally from stainless steel.

* * * * *